US008310503B2

(12) United States Patent
Sung et al.

(10) Patent No.: US 8,310,503 B2
(45) Date of Patent: Nov. 13, 2012

(54) DISPLAY DEVICE AND METHOD OF DRIVING THE SAME

(75) Inventors: Si-Duk Sung, Seoul (KR); Baek-Woon Lee, Yongin-si (KR)

(73) Assignee: Samsung Display Co., Ltd., Yongin (KR)

( * ) Notice: Subject to any disclaimer, the term of this patent is extended or adjusted under 35 U.S.C. 154(b) by 1051 days.

(21) Appl. No.: 12/259,766

(22) Filed: Oct. 28, 2008

(65) Prior Publication Data

US 2009/0122074 A1 May 14, 2009

(30) Foreign Application Priority Data

Nov. 13, 2007 (KR) ..... 10-2007-0115176

(51) Int. Cl.
*G09G 5/02* (2006.01)

(52) U.S. Cl. ..... 345/600; 345/589; 345/604; 345/605; 382/169

(58) Field of Classification Search ..... None
See application file for complete search history.

(56) References Cited

U.S. PATENT DOCUMENTS

| | | | | |
|---|---|---|---|---|
| 2006/0012608 | A1 * | 1/2006 | Lee et al. | 345/591 |
| 2006/0214942 | A1 * | 9/2006 | Tanase et al. | 345/589 |
| 2007/0092138 | A1 * | 4/2007 | Tseng | 382/169 |

FOREIGN PATENT DOCUMENTS

| | | |
|---|---|---|
| JP | 2006163068 | 6/2006 |
| KR | 1020040096273 | 11/2004 |
| KR | 1020070011830 | 1/2007 |
| KR | 1020070065640 | 6/2007 |

* cited by examiner

*Primary Examiner* — Antonio A Caschera
(74) *Attorney, Agent, or Firm* — H.C. Park & Associates, PLC

(57) ABSTRACT

A display device includes a color converter, a timing controller, and a display panel. The color converter converts R, G, and B data into R', G', B', and W' data. The R', G', B', and W' data includes first component data and second component data. The timing controller provides the first component data to a data driver during a first driving time and provides the second component data to the data driver during a second driving time. The data driver provides gray level display voltages corresponding to the first component data and the second component data to a data line, and the display panel displays the R', G', B', and W' data in response to the gray level display voltage.

7 Claims, 3 Drawing Sheets

DISPLAY DEVICE AND METHOD OF DRIVING THE SAME

CROSS-REFERENCE TO RELATED APPLICATION

This application claims priority from and the benefit of Korean Patent Application No. 10-2007-0115176, filed on Nov. 13, 2007, which is hereby incorporated by reference for all purposes as if fully set forth herein.

BACKGROUND OF THE INVENTION

1. Field of Invention

This present invention relates to a display device that can drive red (R), green (G), blue (B), and white (W) pixels and a method of driving the same.

2. Discussion of the Background

Recently, various display devices having reduced weight and size have been developed. Such display devices include a liquid crystal display ("LCD") device, a plasma display panel, and a light emitting display device.

An LCD device includes a thin film transistor substrate including pixel electrodes, a color filter substrate including a common electrode, and a liquid crystal ("LC") layer with dielectric constant anisotropy interposed between the thin film transistor substrate and the color filter substrate. The pixel electrodes are arranged in a matrix shape and connected to thin film transistors, which are switching elements, to receive a data voltage on a line basis. The common electrode is disposed on an entire surface of the color filter substrate to receive a common voltage.

In the LCD device, an electric field is generated in the LC layer by voltages supplied to a pixel electrode and the common electrode, and the transmittance of light transmitted through the LC layer is adjusted by adjusting the intensity of the electric field to display a desired image.

In order to display a color per pixel, red (R), green (G), and blue (B) color filters are provided in areas corresponding to respective pixels. However, since the R, G, and B color filters transmit approximately one-third of the light transmitted through the LC layer, the light efficiency may be decreased.

Accordingly, a four color type LCD including a white (W) pixel in addition to R, G, and B pixels has been proposed to maintain color reproducibility and improve the luminance and the light efficiency of the LCD device.

In the conventional four color type LCD device, although the luminance of achromatic color may be increased, the luminance of R, G, and B colors may still be decreased. As a result, the desired color may not be obtained.

SUMMARY OF THE INVENTION

The present invention provides a display device that displays excess R, G, and B data in an impulsive driving method.

The present invention also provides a method of driving the same.

Additional features of the invention will be set forth in the description which follows, and in part will be apparent from the description, or may be learned by practice of the invention.

The present invention discloses a display device including a color converter, a timing controller, and a display panel. The color converter converts R, G, and B data into R', G', B', and W' data. Each of the R', G', B', and W' data includes first component data and second component data. The timing controller provides the first component data to a data driver during a first driving time and provides the second component data to the data driver during a second driving time. The data driver provides gray level display voltages corresponding to the first component data and the second component data to a data line, and the display panel displays the R', G', B' and W' data in response to the gray level display voltages.

The present invention also discloses a method of driving a display device including sorting R, G, and B data according to each gray level of the R, G, and B data to determine a maximum value $Max_G$, a middle value $Mid_G$, and a minimum value $Min_G$ of the R, G, and B data, converting the maximum value $Max_G$, the middle value $Mid_G$, and the minimum value $Min_G$ into a maximum value $Max_L$, a middle value $Mid_L$, and a minimum value $Min_L$ using a gamma curve, converting colors by extracting the minimum value $Min_L$ for a white luminance component $White_L$ and generating a maximum value $Max_L'$, a middle value $Mid_L'$, and a minimum value $Min_L'$ by scaling the maximum value $Max_L$, the middle value $Mid_L$, and the minimum value $Min_L$ in a fixed scaling method, converting conversely the maximum value $Max_L'$, the middle value $Mid_L'$, the minimum value $Min_L'$, and white luminance component $White_L$ into a maximum value $Max_G'$, a middle value $Mid_G'$, a minimum value $Min_G'$, and a white data W' using the gamma curve, restoring an order of the maximum value $Max_G'$, the middle value $Mid_G'$, the minimum value $Min_G'$ to provide a converted red data R', a converted green data G', and a converted blue data B', and dividing each of the white data W', the converted red data R', the converted green data G', and the converted blue data B' into a first component data and a second component data.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
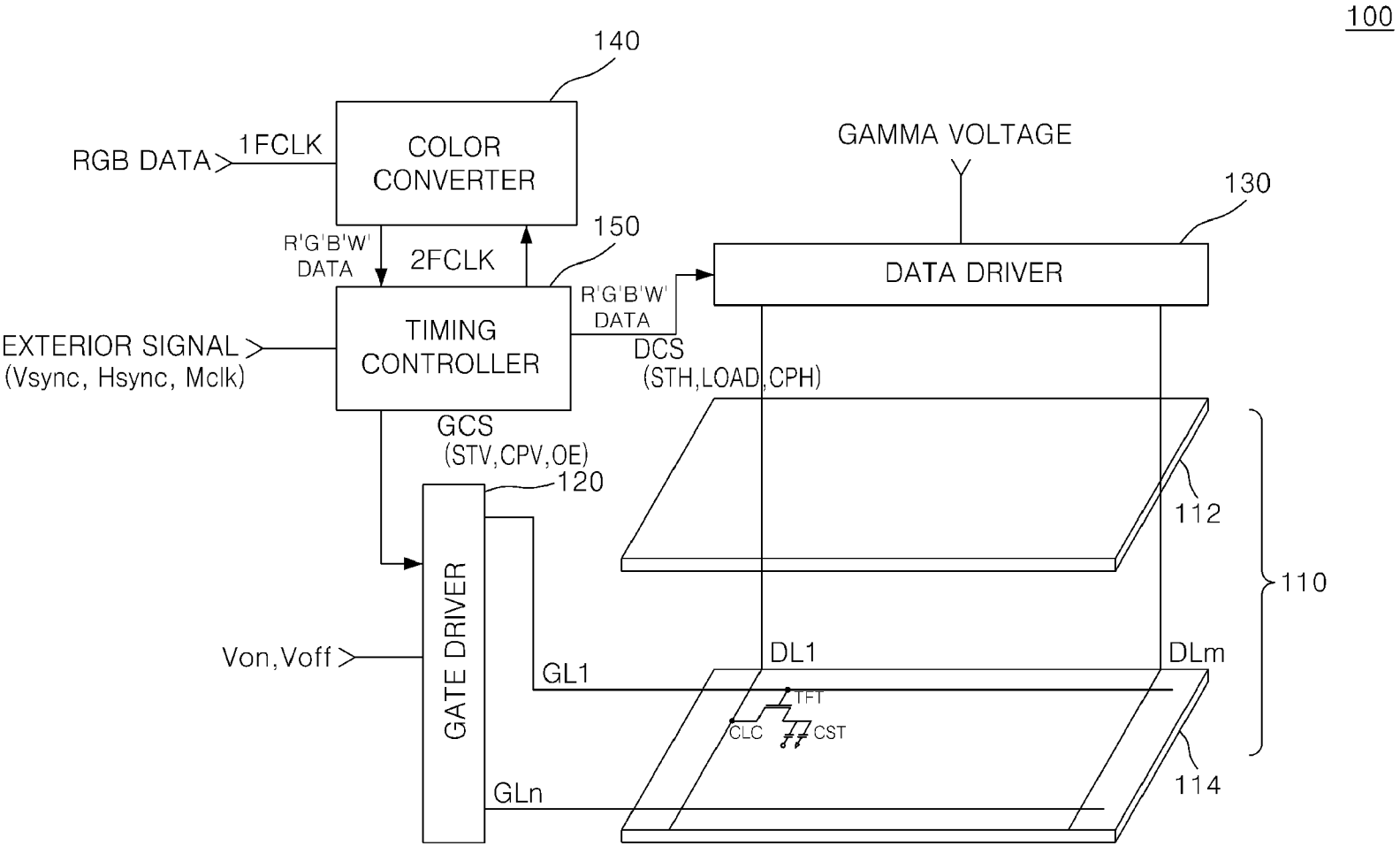
FIG. 1 is a block diagram of a display device according to an exemplary of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element such as a layer, film, region or substrate is referred to as being "on" or "connected to" another element, it can be directly on or directly connected to the other element, or intervening elements may be present. In contrast, when an element is referred to as being "directly on" or "directly connected to" another element, there are no intervening elements present.

FIG. 1 is a block diagram of a display device according to an exemplary of the present invention. Referring to FIG. 1, a display device 100 includes a display panel 110, a gate driver 120, a data driver 130, a color converter 140, and a timing controller 150.

The display panel 110 includes a first substrate 114 including a thin film transistor TFT and a pixel electrode (not shown) in each pixel, a second substrate 112 including a common electrode (not shown), and an LC layer (not shown) interposed the first substrate 114 and the second substrate 112.

The first substrate 114 includes a plurality of data lines DL1 to DLm to transmit a data signal, a plurality of gate lines GL1 to GLn to transmit a driving signal, and a plurality of pixels (red (R), green (G), blue (B), and white (W) color pixels) connected to the gate lines GL1 to GLn and the data lines DL1 to DLm, and arranged in a matrix shape. The data lines DL1 to DLm are parallel to each other in a column direction, and the gate lines GL1 to GLn are parallel to each other in a row direction.

Each pixel includes a TFT connected to a corresponding data line DL1 to DLm and a corresponding gate line GL1 to GLn, and an LC capacitor CLC and a storage capacitor CST that are connected to the TFT. The TFT includes a control terminal connected to a corresponding gate line GL1 to GLn, an input terminal connected to corresponding data line DL1 to DLm, and an output terminal connected to the LC capacitor CLC and the storage capacitor CST.

R, G, or B color filters are provided in areas corresponding to the pixel electrodes of the R, G, and B pixels, respectively, to display the colors. Color filters are not provided in the W pixel. In each pixel, the R, G, B or W color makes a dot. The R, G, or B color filters may be disposed on the second substrate 112 or the first substrate 114.

The transmittance of light changes when the alignment of liquid crystals in the LC layer changes according to an electric field between the pixel electrode and the common electrode.

The gate driver 120 is connected to the gate lines GL1 to GLn of the display panel 110 and provides the gate signal comprised of a gate-on voltage Von and a gate-off voltage Voff to the gate lines GL1 to GLn. The gate driver 120 may be a tape carrier package "TCP" type, a chip on glass "COG" type, or an amorphous silicon gate "ASG" type and is connected to the gate lines GL1 to GLn of the display panel 110.

The data driver 130 is connected to the data lines DL1 to DLm of the display panel 110, and selects a gray level display voltage corresponding to R', G', B', and W' data provided from a timing controller 150 to provide the selected gray level display voltage to the data lines DL1 to DLm. The data driver 130 may be a TCP type, a COG type, or an ASG type and is connected to the data lines DL1 to DLm of the display panel 110.

The color converter 140 converts input R, G, and B data, which is synchronized with a first frequency clock 1FCLK into R', G', B', and W' data, and synchronizes the R', G', B', and W' data with a second frequency clock 2FCLK to provide the R', G', B', and W' data to the timing controller 150. Each of the R', G', B', and W' data includes first unmixed color data and second unmixed color data. The second unmixed color data of the W' data may be zero. A first frequency may be a frequency of a main clock, and a second frequency may be a multiplication frequency of the first frequency. For example, when the first frequency is 60 Hz, the second frequency may be 120 Hz.

A driving period may be the sum of a first sub driving period (a first unmixed color display section) in driving the first frequency clock 1FCLK and a second sub driving period (a second unmixed color display section) in driving the second frequency clock 2FCLK. The driving period may be a horizontal period or a frame period.

The timing controller 150 receives an exterior signal to generate a gate control signal GCS and a data control signal DCS, and provides the generated gate control signal GCS and data control signal DCS to the gate driver 120 and the data driver 130, respectively. In addition, the timing controller 150 provides a second frequency clock 2FCLK that is a multiple of the frequency of the main clock Mclk to the color converter 140. The exterior signal includes a vertical synchronous signal Vsync, a horizontal synchronous signal Hsync, and the main clock Mclk. The gate control signal GCS includes a gate vertical synchronous signal STV, a gate clock CPV, and an output enable signal OE. The data control signal DCS includes a horizontal synchronous signal STH, a load signal LOAD, and a data clock CPH.

The timing controller 150 provides the R', G', B', and W' data from the color converter 140 to the data driver 130 while synchronizing the R', G', B', and W' data with the second frequency clock 2FCLK. The timing controller 150 provides the first unmixed color data provided from the color converter 140 to the data driver 130 during the first sub driving period. The timing controller 150 provides the second unmixed color data to the data driver 130 during the second sub driving period.

Since the display device 100 according to an exemplary embodiment of the present invention can display the first unmixed color data and the second unmixed color data provided from the color converter 140 on the display panel 110 using the multiplication frequency, a decrease in the luminance of the unmixed color may be minimized when converting the R, G, and B data into the R', G', B', and W' data. When a value of the second unmixed color data is zero, an impulsive driving method in which black data is displayed is implemented.

Figure 2:
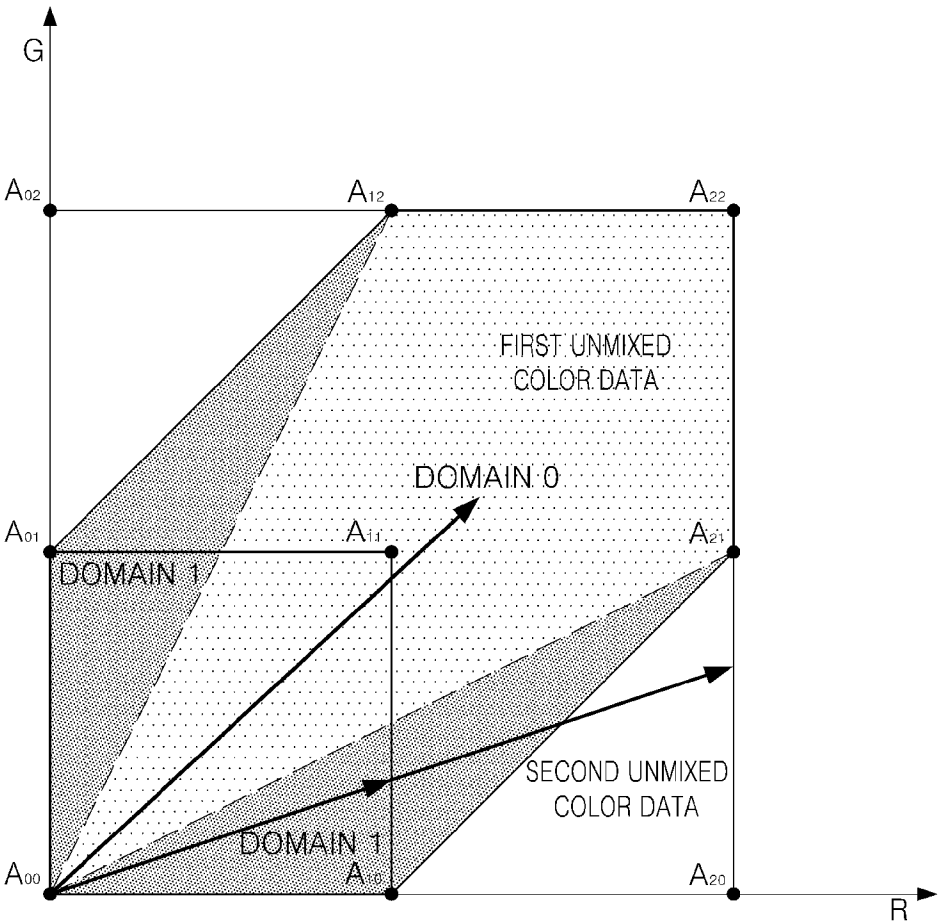
FIG. 2 is a view showing an operation of the color converter of FIG. 1.

FIG. 2 is a view showing an operation of the color converter of FIG. 1. In FIG. 2, three-dimensional-perpendicular coordinates of the R, G, and B colors have been transformed to gamut plane coordinates of the R and G colors.

Referring to FIG. 2, three color data may be displayed in a square area $A_{00}A_{01}A_{11}A_{10}$ shown with a solid line, four color data may be displayed in a hexagon area $A_{00}A_{01}A_{12}A_{22}A_{21}A_{10}$ shown with a solid line.

When adding the W color to the R, G, and B colors to convert the three color data into the four color data, a color area that can display the four colors data is enlarged from the square area $A_{00}A_{01}A_{11}A_{10}$ to the hexagon area $A_{00}A_{01}A_{12}A_{22}A_{21}A_{10}$ along a diagonal direction. In converting the three colors data into the four colors data, each of the coordinates within the square area $A_{00}A_{01}A_{11}A_{10}$ is expanded to coordinates within the hexagon area $A_{00}A_{01}A_{12}A_{22}A_{21}A_{10}$.

A domain area 0 $A_{00}A_{12}A_{22}A_{21}$ shows an achromatic color area where an achromatic color component is more than an unmixed color component, and a domain area 1 $A_{00}A_{01}A_{12}$, $A_{00}A_{21}A_{10}$ shows an unmixed color area where the unmixed color component is more than the achromatic color component. In converting the three color data into the four color data of domain area 0, color conversion may be expanded from the square area $A_{00}A_{01}A_{11}A_{10}$ to segments $\overline{A_{12}A_{22}}$, $\overline{A_{22}A_{21}}$ of the hexagon area $A_{00}A_{01}A_{12}A_{22}A_{21}A_{10}$. Thus, the luminance of the achromatic color area may be remarkably improved. On the other hand, when converting the three color data into the four color data of domain area 1, since the color conversion is expanded from the square area $A_{00}A_{01}A_{11}A_{10}$ to only a segment $\overline{A_{01}A_{12}}$ or segment $\overline{A_{10}A_{21}}$ of the hexagon area $A_{00}A_{01}A_{12}A_{22}A_{21}A_{10}$, the luminance of the unmixed color may be relatively decreased compared to the achromatic color.

The color converter 140 of the exemplary embodiment of the present invention expands a conversion area from the square area $A_{00}A_{01}A_{11}A_{10}$ to a virtual segment $\overline{A_{20}A_{12}}$ or a virtual segment $\overline{A_{20}A_{21}}$ beyond the hexagon area $A_{00}A_{01}A_{12}A_{22}A_{21}A_{10}$ in converting the three color data into the four color data in domain area 1 so that the luminance of the unmixed color may be as improved as the achromatic color.

The luminance of the converted unmixed color is divided into a component (the first unmixed color data) within the hexagon area $A_{00}A_{01}A_{12}A_{22}A_{21}A_{10}$, and a component (the second unmixed color data) beyond the hexagon area $A_{00}A_{01}A_{12}A_{22}A_{21}A_{10}$. The first unmixed color data may be displayed on the display panel 110 during the first sub driving time, the second unmixed color data may be displayed on the display panel 110 during the second sub driving time. The second unmixed color data corresponds to an excess value exceeding the maximum gray level that the unmixed color data may have.

A method for judging a domain of gamut plane coordinates in which the three color data is converted into four color data is as follows. When sorting the input R, G, and B data in gray level order, color conversion is implemented in domain 1 area, when the difference between the largest data gray level and twice the smallest data gray level is larger than zero. The color conversion is implemented in domain 0 in a contrary case. Since converting three color data into four color data may be implemented by the conventional color conversion method in domain area 0, a detailed description of it will be omitted. Hereinafter, an exemplary embodiment and the operation of the color converter 140 about domain area 1 where the luminance of the unmixed color may be decreased will be described.

Figure 3:
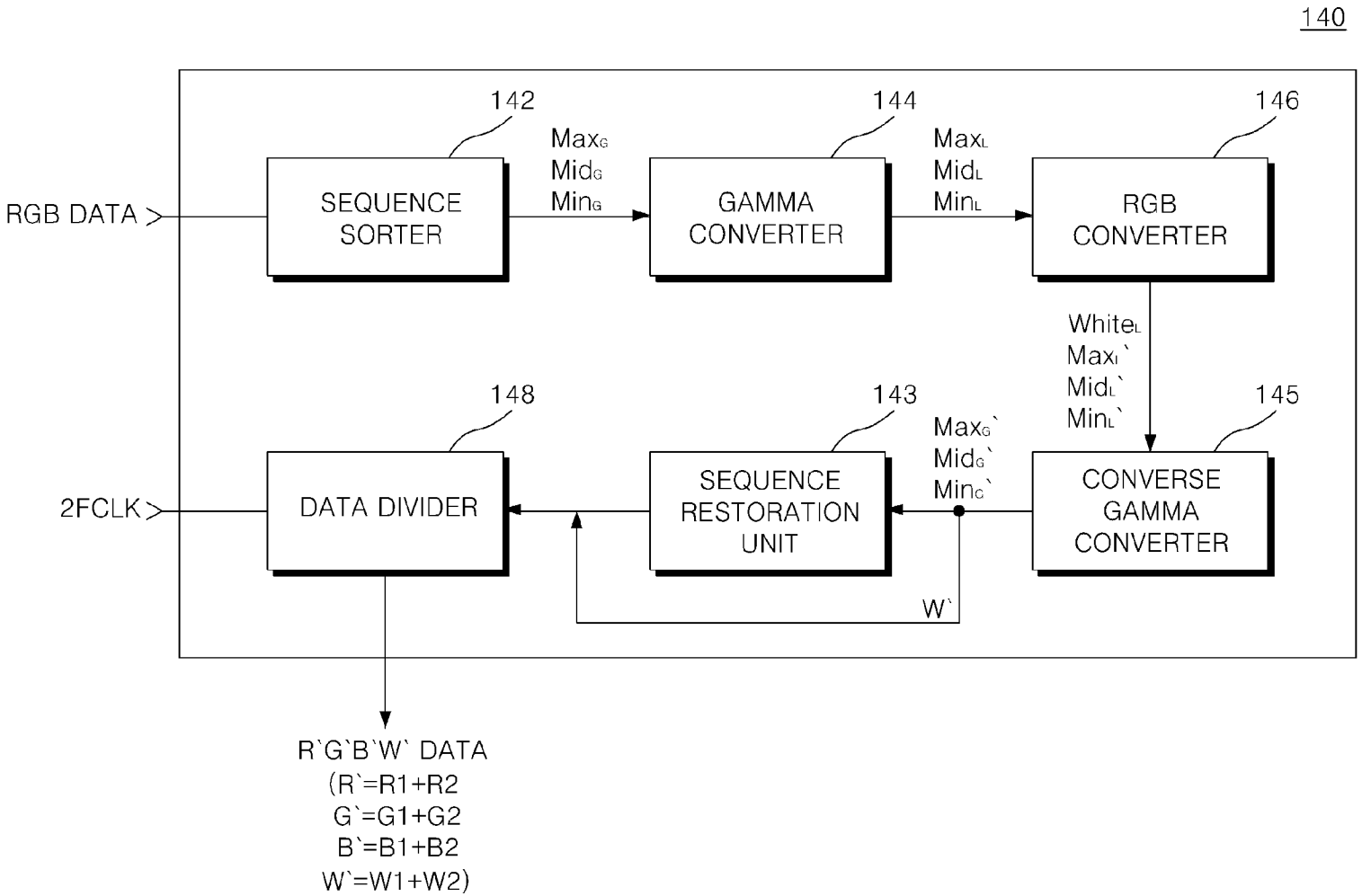
FIG. 3 is a block diagram of the color converter of FIG. 1.

FIG. 3 is a block diagram of the color converter of FIG. 1. Referring to FIG. 3, the color converter 140 includes a sequence sorter 142, a gamma converter 144, an RGB converter 146, a converse gamma converter 145, a sequence restoration unit 143, and a data divider 148.

The sequence sorter 142 determines a maximum value $Max_G$, a middle value $Mid_G$, and a minimum value $Min_G$ of the R, G, and B data and provides the values to the gamma converter 144 by sorting the input R, G, and B data according to the respective gray levels of the R, G, and B data. For this, the sequence sorter 142 may sort the R, G, and B data in gray level size order and may endow an order index according to the sorted order. The maximum value $Max_G$, the middle value $Mid_G$, and the minimum value $Min_G$ are gray scale data.

The gamma converter 144 converts the maximum value $Max_G$, the middle value $Mid_G$, and the minimum value $Min_G$ provided from the sequence sorter 142 into a maximum value $Max_L$, a middle value $Mid_L$ and a minimum value $Min_L$ using a gamma curve, and provides the converted values to the RGB converter 146. The gamma curve shows a relationship between the gray level and the luminance. During gamma conversion, the gray level is converted into luminance using the gamma curve. Accordingly, the maximum value $Max_L$, the middle value $Mid_L$ and the minimum value $Min_L$ from the gamma converter 144 are luminance data.

The RGB converter 146 extracts the minimum value $Min_L$ from the gamma converter 144 as a white luminance component $White_L$ and provides the extracted white luminance component $White_L$ to the converse gamma converter 145. In addition, the RGB converter 146 scales the maximum value $Max_L$, the middle value $Mid_L$ and the minimum value $Min_L$ using a fixed scale method, as described in more detail below, and provides the scaled values $Max_L'$, $Mid_L'$, and $Min_L'$ to the converse gamma converter 145.

The converse gamma converter 145 conversely converts the maximum value $Max_L'$, the middle value $Mid_L'$, the minimum value $Min_L'$, and the white luminance component $White_L$ into a maximum value $Max_G'$, a middle value $Mid_G'$, a minimum value $Min_G'$, and white data W'. Then the converse gamma converter 145 provides the maximum value $Max_G'$, the middle value $Mid_G'$, and the minimum value $Min_G'$ to the sequence restoration unit 143, and provides the white data W' to the data divider 148.

The sequence restoration unit 143 restores the order of the maximum value $Max_G'$, the middle value $Mid_G'$, and the minimum value $Min_G'$ provided from the converse gamma converter 145, determines R', G', and B' data, and provides the R', G' and B' data to the data divider 148. The sequence restoration unit 143 may use the order index generated from the sequence sorter 142 to restore the order.

The data divider 148 divides each of the R', G', B', and W' data generated by the sequence sorter 142, the gamma converter 144, the RGB converter 146, the converse gamma converter 145, and the sequence restoration unit 143 into first unmixed color data and second unmixed color data. The data divider 148 provides the first unmixed color data to the timing controller 150 (see FIG. 1) during the first driving time, and provides the second unmixed color data to the timing controller 150 during the second driving time while synchronizing the first unmixed color data and the second unmixed color data with the second frequency clock 2FCLK.

The operation of the RGB converter 146 will be described in more detail below. The RGB converter 146 extracts the minimum value $Min_L$ for the white luminance component $White_L$ from the gamma converter 144 using equation 1.

$$White_L = Min_L \quad \text{<Equation 1>}$$

The RGB converter 146 generates the maximum value $Max_L'$, the middle value $Mid_L'$, and the minimum value $Min_L'$ using equations 2, 3, and 4. The maximum value $Max_L'$, the middle value $Mid_L'$, and the minimum value $Min_L'$ are generated by changing the luminance of the maximum value $Max_L$, the middle value $Mid_L$ and the minimum value $Min_L$ provided from the gamma converter 144 by the fixed scale method.

$$Max_L' = 2Max_L - Min_L \quad \text{<Equation 2>}$$

$$Mid_L' = 2Mid_L - Min_L \quad \text{<Equation 3>}$$

$$Min_L = 2Min_L - Min_L = Min_L \quad \text{<Equation 4>}$$

The maximum value $Max_L'$, the middle value $Mid_L'$, and the minimum value $Min_L'$ may have an excess gray level component (second unmixed color data) exceeding the gray level (first unmixed color data) that may be actually displayed by the display panel 110.

A description of the excess gray level component will be described below by describing the operation of the data divider 148. The data divider 148 divides each of the R', G', B', and W' data into first unmixed color data $R_1$, $G_1$, $B_1$, and $W_1$ and second unmixed color data $R_2$, $G_2$, $B_2$, and $W_2$. This may be shown by equations 5-8.

$$R' = R_1 + R_2 \quad \text{<Equation 5>}$$

$$G' = G_1 + G_2 \quad \text{<Equation 6>}$$

$$B'=B_1+B_2 \quad \text{<Equation 7>}$$

$$W'=W_1+W_2 \quad \text{<Equation 8>}$$

For example, when input 8-bit R, G, and B data, which may be expressed by gray levels 0 to 255, has data values corresponding to gray levels of 150, 200, and 240, respectively, after gamma conversion, the white data W' may have a data value corresponding to a gray level of 200, and the maximum value $Max_L'$, the middle value $Mid_L'$, and the minimum value $Min_L'$ may have B data corresponding to a gray level of 330(2*240−150=330), G data corresponding to a gray level of 250(2*200−150=250), and R data corresponding to a gray level of 150(2*150−150=150), respectively using the equations 1-4.

Since the maximum gray level of 8-bit gray level is 255, the W' data, the B' data, the G' data, and the R' data may be respectively shown with the first unmixed color data and the second unmixed color data as $B'=B_1+B_2=255+75$, $G'=G_1+G_2=250+0$, $R'=R_1+R_2=150+0$, and $W'=W_1+W_2=150+0$.

The data divider 148 provides the first unmixed color data $R_1$, $G_1$, $B_1$, and $W_1$ and the second unmixed color data $R_2$, $G_2$, $B_2$, and $W_2$ to the timing controller 150 while synchronizing the first unmixed color data $R_1$, $G_1$, $B_1$, and $W_1$ and the second unmixed color data $R_2$, $G_2$, $B_2$, and $W_2$ with the second frequency clock 2FCLK from the timing controller 150. The timing controller 150 provides the first unmixed color data $R_1$, $G_1$, $B_1$, and $W_1$ to the data driver 130 (see FIG. 1) during the first driving time and provides the second unmixed color data $R_2$, $G_2$, $B_2$, and $W_2$ to the data driver 130 during the second driving time, which may prevent the luminance of the unmixed color data from decreasing when the three color data is converted into four color data. In addition, when the first unmixed color data $R_1$, $G_1$, $B_1$, and $W_1$ does not exceed the maximum gray level of 255, the second unmixed color data $R_2$, $G_2$, $B_2$, and $W_2$ becomes zero. At this time, black data corresponding to the zero gray level is provided to the data driver 130 during the second driving time to be driven by the impulsive driving method.

Since the exemplary embodiments of the present invention may display excess R, G, and B data generated during the conversion of three color data into four color data in the impulsive driving method, the exemplary embodiments of the present invention may reduce the decrease in the luminance of the unmixed color and a motion blur phenomenon of a movie.

The display device and the method of driving the same according to exemplary embodiments of the present invention may be used in a four color data display device. The display device may include a mobile communication device, a multimedia device demanding slimness and lightweight, and a large size television set with low power consumption and slimness.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A method of driving a display device using a processor, comprising:

sorting R data, G data, and B data according to each gray level of the R data, the G data, and the B data to determine a maximum value $Max_G$, a middle value $Mid_G$, and a minimum value $Min_G$ of the R data, the G data, and the B data;

converting the maximum value $Max_G$, the middle value $Mid_G$, and the minimum value $Min_G$ into a maximum value $Max_L$, a middle value $Mid_L$, and a minimum value $Min_L$ using a gamma curve;

converting colors, using the processor, by extracting the minimum value $Min_L$ for a white luminance component $White_L$, and generating a maximum value $Max_L'$, a middle value $Mid_L'$, and a minimum value $Min_L'$ by scaling the maximum value $Max_L$, the middle value $Mid_L$, and the minimum value $Min_L$ using a fixed scaling method;

converting conversely the maximum value $Max_L'$, the middle value $Mid_L'$, the minimum value $Min_L'$, and the white luminance component $White_L$ into a maximum value $Max_G'$, a middle value $Mid_G'$, a minimum value $Min_G'$, and a white data W' using the gamma curve;

restoring an order of the maximum value $Max_G'$, the middle value $Mid_G'$, the minimum value $Min_G'$ to provide a converted red data R', a converted green data G', and a converted blue data B'; and dividing each of the white data W', the converted red data R', the converted green data G', and the converted blue data B' into a first component data and a second component data.

2. The method of claim 1, wherein converting the colors using the fixed scaling method comprises generating the maximum value $Max_L'$, the middle value $Mid_L'$, and the minimum value $Min_L'$ using the below equations.

$$Max_L'=2Max_L-Min_L$$

$$Mid_L'=2Mid_L-Min_L$$

$$Min_L'=Min_L.$$

3. The method of claim 1, wherein the first component data are a maximum gray level or less, the maximum gray level being the highest gray level that can be displayed by a display panel.

4. The method of claim 3, wherein the first component data are less than the maximum gray level, and the second component data are a minimum gray level, the minimum gray level being the lowest gray level that can be displayed by the display panel.

5. The method of claim 4, further comprising displaying the first component data on the display panel during a first driving time; and displaying the second component data on the display panel during a second driving time.

6. The method of claim 3, wherein the first component data are the maximum gray level, and the second component data exceeds the minimum gray level.

7. The method of claim 6, further comprising displaying the first component data on the display panel during a first driving time; and displaying the second component data on the display panel during a second driving time.

* * * * *